United States Patent [19]

Clarke

[11] Patent Number: 5,066,070

[45] Date of Patent: Nov. 19, 1991

[54] APPARATUS FOR REFLEX-PERCUSSIVE CUTTING OF CONCRETE ETC.

[76] Inventor: Ronald A. W. Clarke, 501 Wilkins St, Apt 717, London, Ontario, N6C 5G2, Canada

[21] Appl. No.: 543,732

[22] PCT Filed: Feb. 8, 1989

[86] PCT No.: PCT/GB89/00117

§ 371 Date: Aug. 3, 1990

§ 102(e) Date: Aug. 3, 1990

[87] PCT Pub. No.: WO89/07690

PCT Pub. Date: Aug. 24, 1989

[30] Foreign Application Priority Data

Feb. 10, 1988 [GB] United Kingdom ..... 8803087

[51] Int. Cl.[5] ..... E01C 23/09

[52] U.S. Cl. ..... 299/37; 125/6; 125/40; 173/13; 299/94

[58] Field of Search ..... 299/37, 69, 94; 404/89, 404/90; 125/6, 7, 40; 173/13, 15, 17, 116

[56] References Cited

U.S. PATENT DOCUMENTS

| | | | |
|---|---|---|---|
| 3,366,420 | 1/1968 | Young | 299/37 |
| 3,664,707 | 5/1972 | Fleigher | 299/38 |
| 3,810,676 | 5/1974 | Clarke | 299/1 |
| 3,904,245 | 9/1975 | Clarke | 299/37 |
| 3,915,582 | 10/1975 | Clarke | 404/75 |
| 4,451,093 | 5/1984 | Perez | 299/94 X |

FOREIGN PATENT DOCUMENTS

| | | |
|---|---|---|
| 202013 | 11/1986 | European Pat. Off. . |
| 2355232 | 5/1975 | Fed. Rep. of Germany . |
| 451989 | 5/1968 | Switzerland . |
| 2128232 | 4/1984 | United Kingdom . |

*Primary Examiner*—David J. Bagnell

*Attorney, Agent, or Firm*—Anthony Asquith & Co.

[57] ABSTRACT

The machine includes a reciprocating piston/hammer (10) assembly, which is constrained against rotation in the cylinder (8). This allows the cutting bit to apply concentrated action along a line, and thus is useful for cutting grooves. The cutting bars (40) are arranged in sequence to enter progressively deeper into the groove. Many bits are arranged side by side, for cutting parallel grooves simultaneously.

11 Claims, 6 Drawing Sheets

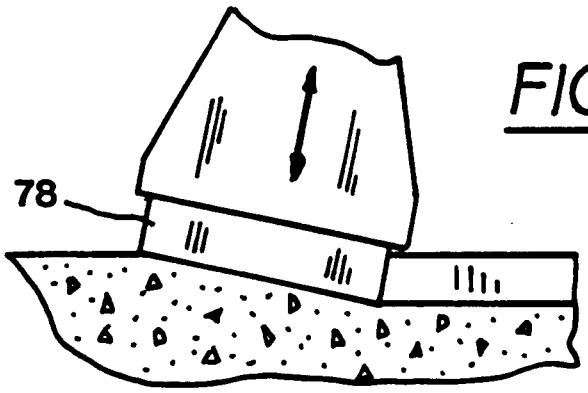
FIG 10
FIG 11
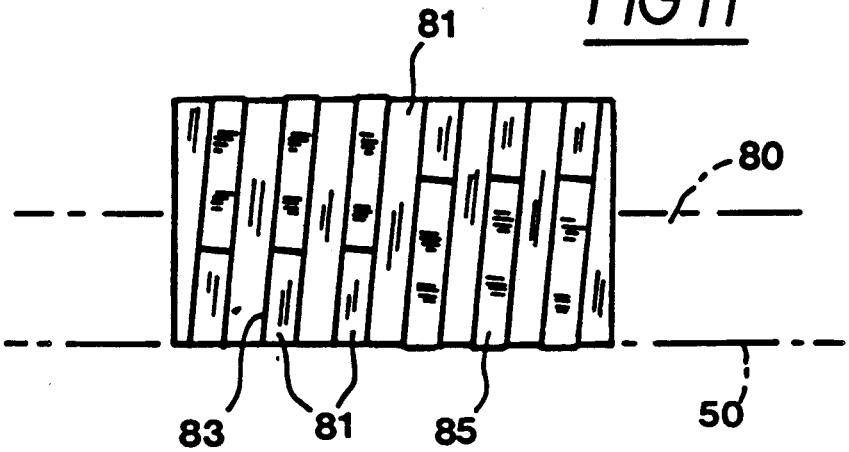

APPARATUS FOR REFLEX-PERCUSSIVE CUTTING OF CONCRETE ETC.

This invention relates to apparatus for cutting hard, brittle materials, such as concrete, and asphalt.

BACKGROUND TO THE INVENTION

The process for cutting grooves in concrete that has now come to be known as the reflex-percussive process, makes use of repeated, short, sharp hammer blows. The reflex-percussive process may be distinguished from that of the normal pneumatic hammer or drill as follows.

In a common pneumatic drill, a piston reciprocates in a cylinder. Each stroke, the piston strikes an anvil, and on the end of the anvil is a cutting bit. After the blow is struck, the piston retracts. Cutting takes place by a combination of a pounding or crushing action and an abrasive action.

In the conventional pneumatic drill, the anvil may be returned by a spring, or by the exhausted pneumatic air. Either way, the piston retracts as a separate entity from the anvil. The result is that the anvil tends to remain in contact with the surface of the concrete for the fraction of a second required for the shockwave generated by the blow to travel into the concrete, to be reflected back from the undersurface or from the bulk of the concrete, and to re-appear at the surface to "bounce" the anvil clear of the surface.

In reflex-percussion, on the other hand, there is no separately movable anvil. The cutting bit is attached directly to, and is unitary with, the pneumatic piston. In addition, pressurised air acts to withdraw the piston forcibly. Now, the bit is withdrawn from the surface virtually at the instant the blow has been struck, and before the shockwave has had the opportunity to travel into the bulk of the concrete and be reflected back to the surface. The result is that when the reflected shockwave finally does reach the surface, the surface is exposed and unsupported by the mass of the anvil. The material in the surface zone consequently is subjected to a sudden large peak of tensile stress. Concrete is weak in tension, and with many repeated such blows, the surface zone starts to break up.

In reflex percussion, the tool or bit need not be sharply pointed, as is necessary in conventional cutting, to concentrate the energy of the blow. In reflex percussion, the cutting takes place as a result of repeated, relatively light, hammer blows.

The attributes of reflex-percussive cutting may be summarised as follows.

Reflex-percussion produces waste in the form of good-sized chips and pellets. These pellets break away from the surface relatively cleanly, and one of the benefits of reflex-percussion is the reduction in the amount of dust produced during cutting, compared with abrasive or crushing processes such as drilling or sawing.

Reflex-percussion operates efficiently with hard, brittle materials, and materials that are stronger in compression than in tension. Shockwaves are reflected predominantly from the remote surface of the concrete or other material (for example, the undersurface of the road) if that remote surface is well supported. Otherwise, a shockwave can be reflected from the mass or bulk of the material. In contrast to most other cutting processes, the harder the material, the more effective and more efficient the reflex percussion process becomes.

From the standpoint of efficiency, it is important to note that reflex-percussion uses far more compressed air than an ordinary pneumatic drill with the same nominal capacity. This is because air has to be provided under full pressure to return the whole piston/anvil/bit assembly. However, the more appropriate measure of efficiency is the amount of pressurised air required per unit of concrete material removed, and on that scale reflex-percussion is comparatively very efficient.

Machines working on the reflex-percussion principle are shown in, for example, U.S. Pat. No. 3,810,676 (CLARKE, May 1974), U.S. Pat. No. 3,904,245 (CLARKE, September 1975), and U.S. Pat. No. 3,915,582 (CLARKE, October 1975).

GENERAL DESCRIPTION OF THE INVENTION

In the reflex percussion machines shown in the prior art, the unitary piston/bit assembly has been mounted for free reciprocating movement within the pneumatic cylinder. The fact that the pistons and cylinders were circular has meant that, in the prior art, the pistons not only reciprocated, but were also free to rotate with respect to the cylinders.

This rotation was thought to be necessary, for the purpose of avoiding a concentration of the cutting force at any one point of the bit, and of allowing many cutting edges, spread over the end of the bit, to play a part in the cutting process.

In the invention, by contrast, the reflex percussion apparatus is provided with an anti-rotation means, whereby the piston/bit assembly is prevented from rotating with respect to the cylinder.

One of the major advantages of providing the anti-rotation means of the invention is realised when cutting grooves. In groove-cutting, the cutting bit traverses steadily over the surface, along the line of the groove. It has been found, in the invention, that the cut edges of the groove tend to be cleaner, and to have less spalling or breaking-up problems, than has been the case in previous reflex percussion grooving machines, where the cutting bit was able to rotate freely.

In the invention, the non-rotatable bit can be designed to take advantage of the fact that rotation is prevented, in that the actual percussion bars may be aligned with the direction of traverse of the bit along the groove. The non-rotatable bit can be designed with percussion bars that deliver blows which are progressively deeper, so that fewer passes are needed to cut grooves of the required depth. Preferably, a groove should be cut with only one pass, to avoid the problem of trying to line up the bit for a second pass in the first cut.

In the invention, because the bit is constrained against rotation, the cutting action can be concentrated along the line of the groove. This accounts for the cleaner edge to the groove.

The cleaner edge to the groove tends to be obtained, with the non-rotating piston/bit assembly of the invention, even though the material is non-homogeneous. Concrete consists of relatively hard pebbles, set in a relatively soft matrix. In a groove cut in accordance with the invention, the clean edge may be seen to pass right through the matrix and the hard pebble, and the line of the groove is still maintained cleanly, and without any significant tearing-out of the pebble, nor any crumbling of the matrix at the transition.

The anti-rotation means of the invention can be quite light as regards its physical structure. This is because the anti-rotation means does not need to support any torque loading between the piston and the cylinder. Only a nominal guiding or location action is required. Similarly, the anti-rotation means can be easily arranged so as to impose only negligible friction on the reciprocating motion.

DETAILED DESCRIPTION OF PREFERRED EMBODIMENT

By way of further explanation of the invention, examples of actual machines which embody the invention will now be described, with reference to the accompanying drawings, in which:

FIGS. 8, 9 and 10 are side views of further cutting bits;

FIG. 11 is a plan view of a further bit.

Figure 1:
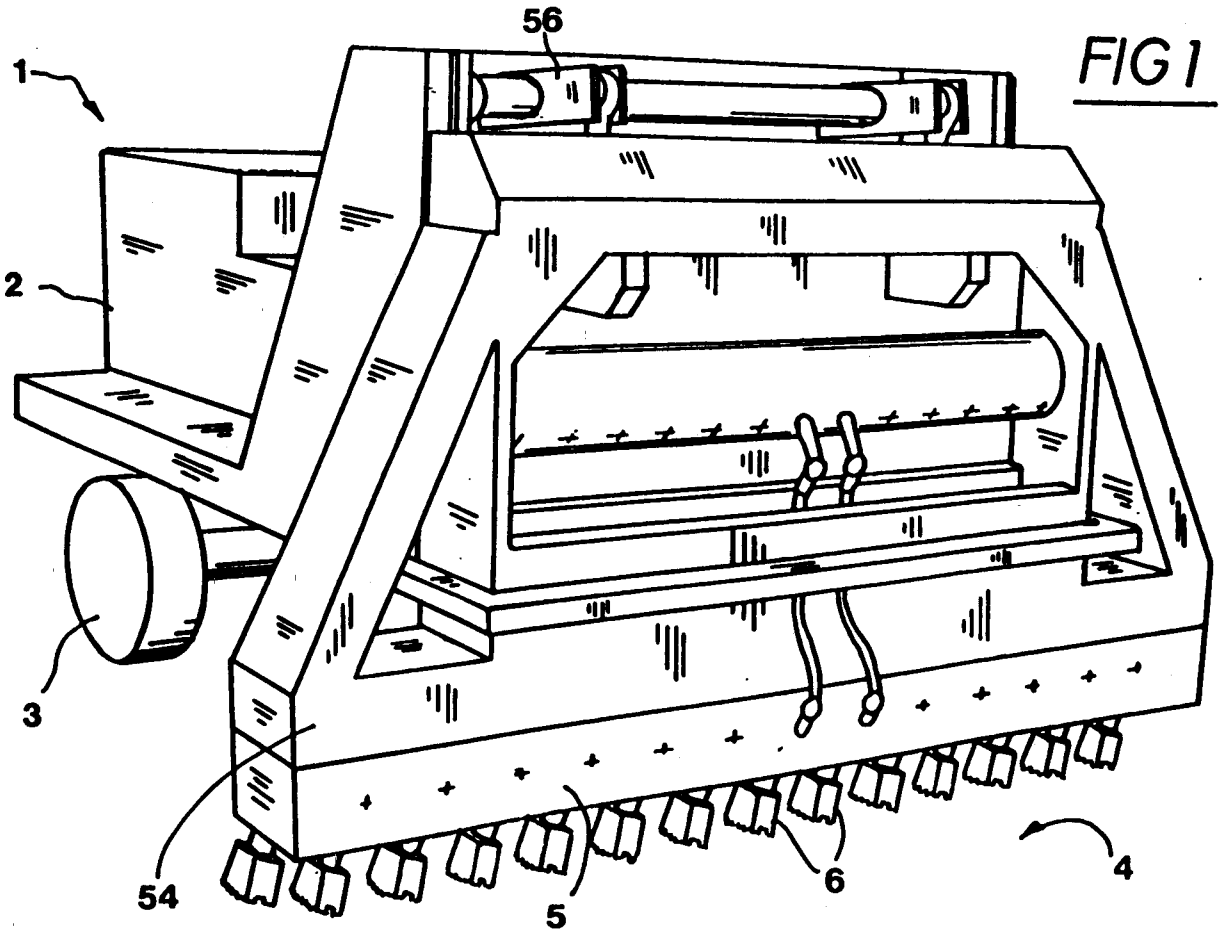
FIG. 1 is a pictorial view of a machine or apparatus for cutting grooves in the surface of a road or runway.

The apparatus of FIGS. 1 to 6 includes a frame 2 which is mounted on wheels 3, and includes a means for propelling the apparatus along the surface 4 to be cut.

The apparatus 1 includes a cylinder block 5. The block 5 is mounted in the frame 2 in such a manner that the block may be raised and lowered relative to the frame, so that the height of the cutting assemblies 6 may be set, with respect to the concrete surface 4.

Figure 2:
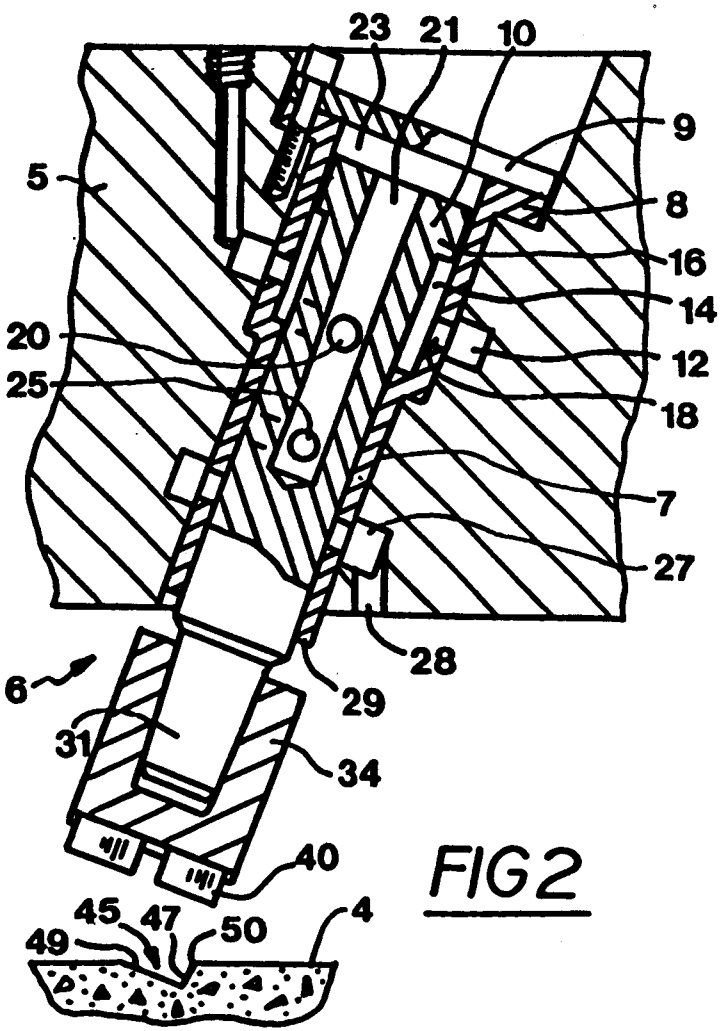
FIG. 2 is a cross section of a reciprocating assembly, which is a component of the apparatus of FIG. 1.

A cross-section of one of the cutting assemblies is shown in FIG. 2.

The block 5 is formed with a cylinder bore 7. A liner 8, and a cap 9, define a working cylinder for a piston 10. The piston is provided with through holes and chambers as illustrated.

The piston is caused to reciprocate in the following manner. Air under pressure is supplied to the annular port 12, and enters the space 14 under the head 16 of the piston through holes 18 in the liner 8. The air flows through holes 20 in the piston 10, and into the central chamber 21 of the piston. The air therefore enters the space 23 above the piston. The space 23 has a larger area exposed to the air pressure than the space 14, and so the piston 10 is driven downwards.

The piston 10 is provided with a further hole 25, which extends from the chamber 21 through the wall of the piston. When the piston reaches the FIG. 3 position, the hole 25 communicates the chamber 21 with the annular port 27, through which the air exhausts, through conduits 28, to the surrounding atmosphere. At the same time, the holes 20 are blanked off. The result is that the space 23 above the piston 10 is at exhaust pressure, whereas the annular space 14 is at supply pressure. The piston is therefore driven back upwards, by the air pressure acting over the area of the annular space 14.

Figure 3:
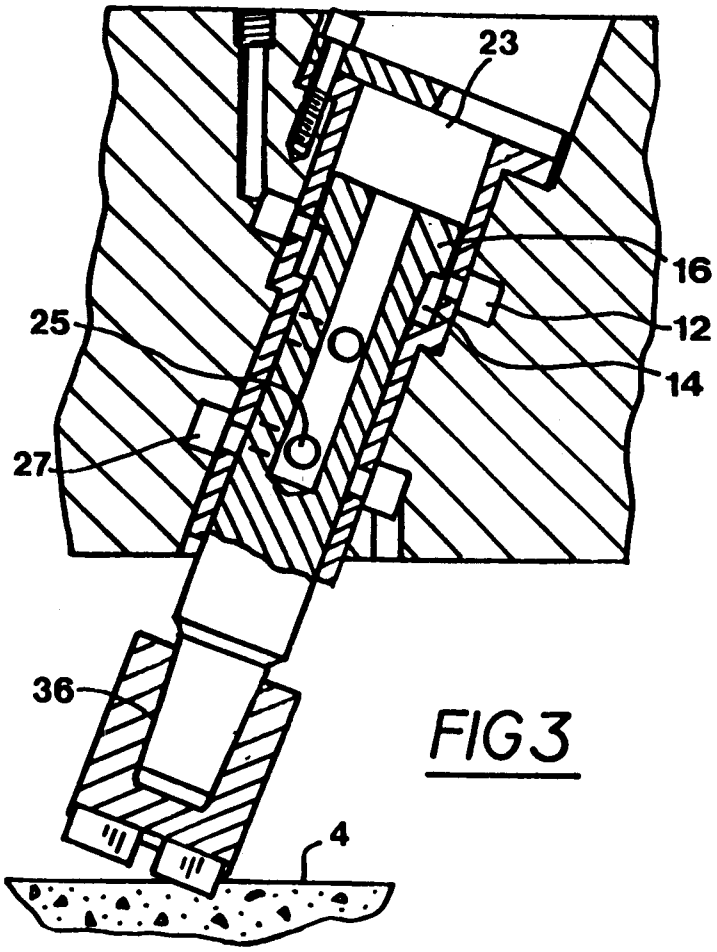
FIGS. 3 and 4 are sections corresponding to FIG. 2, showing the assembly at different points of travel.
Figure 4:
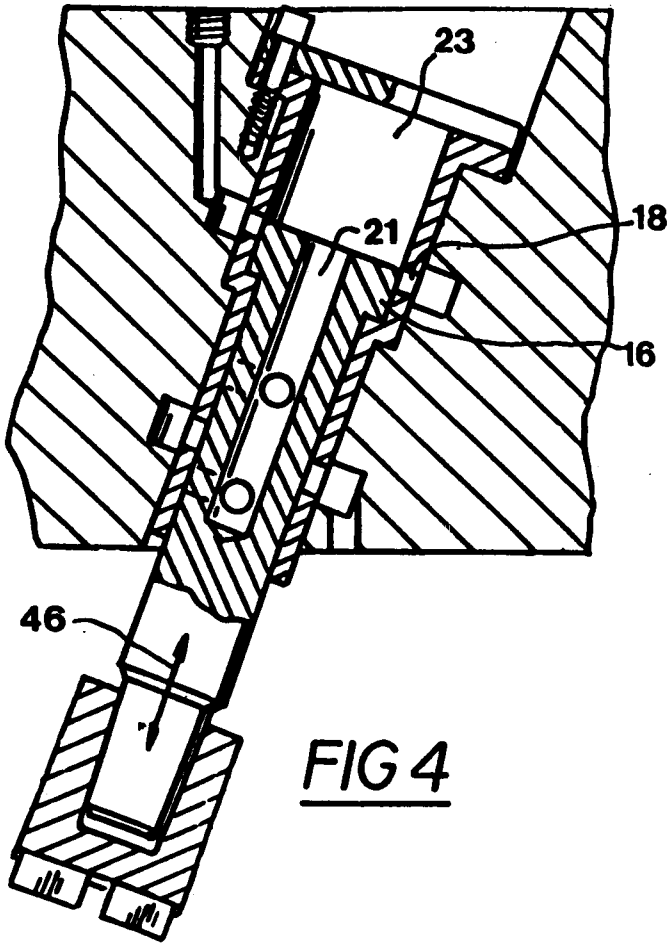

If, when the piston is driven downwards, no resistance is encountered, the piston has enough momentum to pass through the FIG. 3 condition without stopping, and to reach the FIG. 4 condition. Here, the head 16 of the piston 10 has passed below the port 12, and the hole 25 is blanked off, so that the air pressure now holds the piston down, and the piston does not reciprocate.

Figure 5:
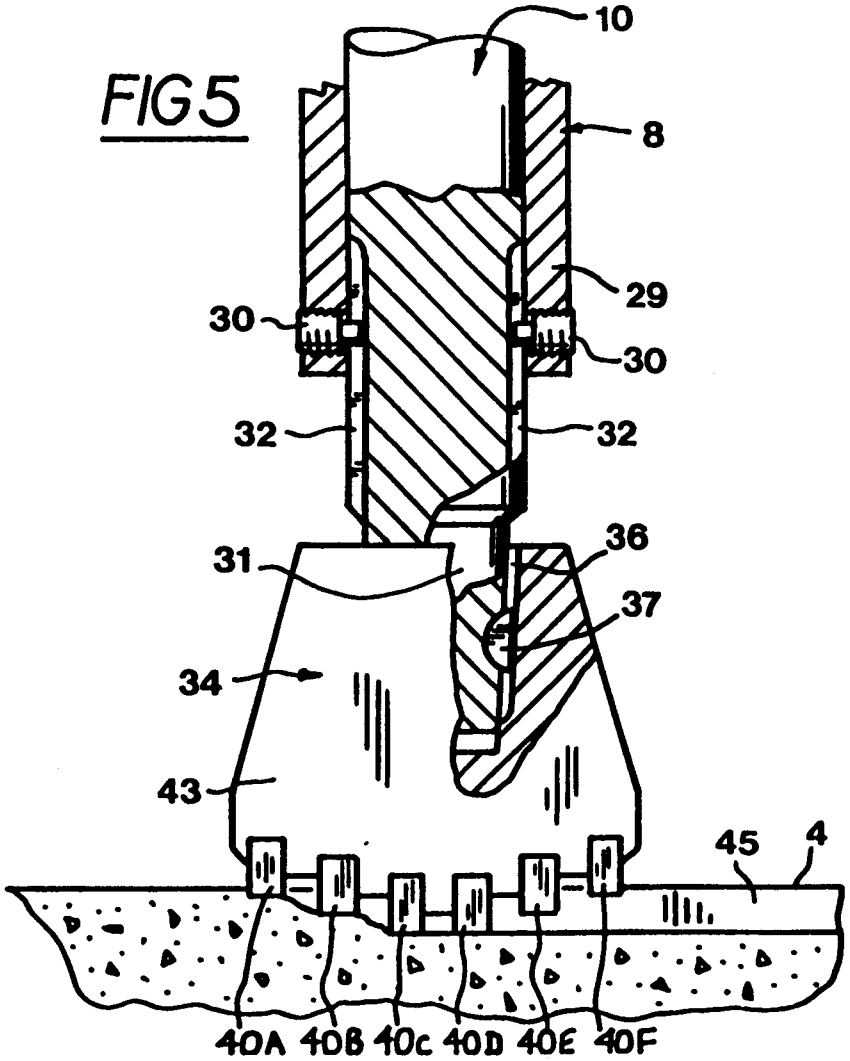
FIG. 5 is a side view of one of the cutting bits of the apparatus of FIG. 1.
Figure 6:
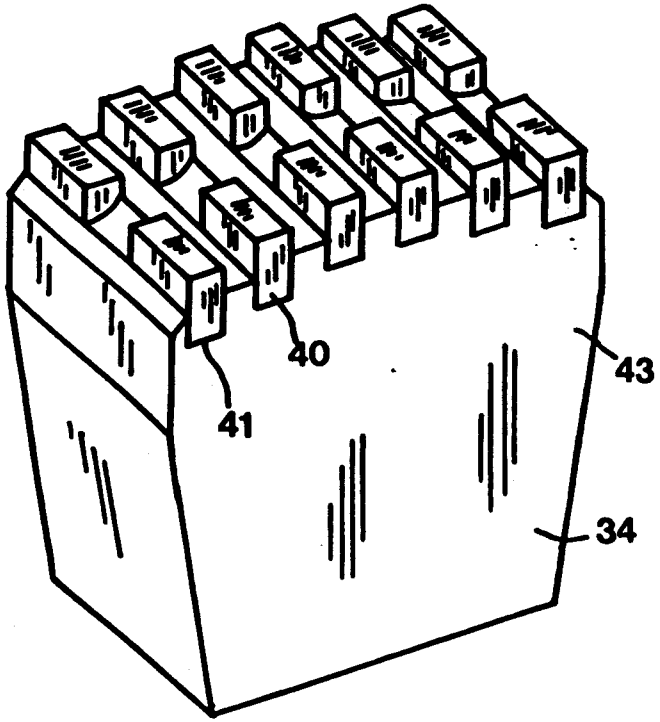
FIG. 6 is a pictorial view of the said bit.

The liner 8 is provided with a skirt 29, into which is secured a peg 30 (FIG. 5). The peg 30 engages a complementary groove 32 formed in the piston 10, and together the peg and the groove form an anti-rotation means between the block 5 and the piston 10. As the piston 10 reciprocates in the block 5, it is therefore constrained against rotation within the block. A corresponding peg and groove are provided on the opposite side of the piston, for symmetry.

The nose of the piston 10 is provided with a taper 31. A percussion bit 34 is provided with a complementary taper 36, the bit 34 being secured to the piston by the action of driving the tapers together. When thus assembled, the piston and bit are unitary, i.e. for all practical purposes it is as if the two were made from the same block of material. A Woodruff key 37 in the tapered nose 31 engages a complementary keyway in the tapered hole 36, to ensure the correct orientation of the bit 34 with respect to the piston 10.

The bit 34 is provided with a total of twelve percussion bars 40. Six slots 41 are cut across the bottom face of the body 43 of the bit 34, and the bars 40 are let into the slots 41, in the manner shown in FIG. 6. The bars 40 are brazed or silver-soldered into the slots 41. The bars 40 are made of tungsten carbide, and the body 43 is of toughened steel.

The bars 40 are arranged in rows, and the bars are set at the differing depths as shown in FIG. 5. The piston 10 and the bit 34 comprise a reciprocating hammer, which is of such a mass that it will reciprocate at a rate of 5 or 10 blows per second, using air pressures of 5 or 6 atmospheres, which is within the normal range for industrial pneumatic equipment. In the configuration shown, each bar 40 can comfortably cut to a depth of 2 or 3 mm per pass, so that the three bars 40*a*, 40*b*, 40*c* when arranged in a descending series as shown, can cut a groove to a depth of about 6 or 9 mm, in one pass.

For water run-off grooves in roads and runways, a groove depth of 6 to 9 mm is generally accepted as ideal.

It is because the piston/bit assembly is prevented from rotating, in the invention, that the bars 40 can be arranged so as to cut progressively deeper.

As shown, the bars 40*d*, 40*e*, 40*f* are not used for cutting during a forward pass of the apparatus. These bars, however, come into play when the apparatus is reversed. The apparatus as shown therefore can cut grooves when moving either forwards or backwards.

The corresponding bars on the other side (i.e. the left side in FIG. 2) of the body 43 are spares. When the bars 40*a–f* have become chipped, or otherwise worn, the bit 34 may be removed from the taper 31, and rotated through 180 degrees, so that the other six bars may be brought into use.

Figure 7:
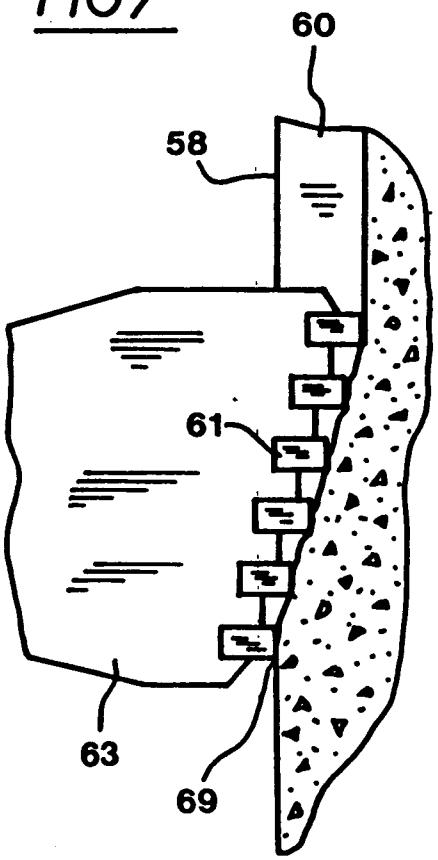
FIG. 7 is a side view of the bit of an alternative apparatus.

Alternatively, as shown in FIG. 7, if it is desired to cut grooves to a greater depth, all six bars on one side can be arranged in progressive descending order, and the apparatus used in just one direction. Thus, if each bar were to cut to a depth of 2 or 3 mm, a groove of a total depth of 12 to 18 mm could be made by arranging all six bars on one side in progressive descending order.

As shown in FIGS. 2–4, the axis 46 of the reciprocating assembly is set at an angle. The grooves 45 produced are of a skewed V-shape, comprising a steeply sloping face 47 and a gently sloping face 49. This shape has been found to be particularly advantageous for water run-off grooves in aircraft runways, and also in roads.

It is important, for the best performance of such grooves, that the edge 50 at the intersection between the steeply sloping face 47 and the surface 4 of the concrete should be clean and sharp, and not spoilt by pitting, spalling, or crumbling. It is recognised in the invention that when grooves of this shape are cut by the conventional reflex percussion process, in which the bit is allowed to rotate, it is almost impossible to achieve a good, clean edge 50. But because, in the invention, the bit is prevented from rotating, and the bars 40 can be arranged in the progressive manner shown, the cutting action can be directed and concentrated in the critical area.

The cylinder block 5 of the apparatus is mounted on a subframe 54, which may be raised and lowered with respect to the frame 2. At the commencement of a cutting operation, the bits are all in the FIG. 4 position, held there by the air pressure. As the block 5 is lowered, the pistons are forced up into the block, until they reach the FIG. 3 position. Reciprocation then commences, and continues until the block is again raised. The raising and lowering of the subframe 54 is accomplished by pneumatic rams 56.

The particular apparatus shown in FIG. 1 includes a total of twenty-six reciprocating assemblies. These are arranged in the block in two rows of thirteen. The assemblies are staggered, row to row, so that the pitch of the grooves to be cut is half the distance between adjacent assemblies.

It is important that the block 5 be solid and rigid and massive. First, the quality of the edge 50 depends to some extent on the accuracy with which the repeated blows of the bars come down onto the surface 4. If the bars were allowed to wander or deviate, even fractionally, between blows, the quality of the edge 50 would be affected.

The provision of the rigid, massive block 5 means that the reciprocating assemblies are accurately constrained to follow very closely the line of the groove.

Another reason why it is advantageous that the block 5 should be massive is that, at the commencement of cutting, it often happens that a good many of the pistons start to hammer all at the same instant: when that happens, if the block were light, the machine might suffer uncontrolled bouncing or hopping, until the pistons could settle down to independent random motion at their different phases and frequencies. A massive block resists any tendency of the apparatus to bounce or hop.

The frame 2 also contributes to the massiveness of the block 5, especially if the guides upon which the subframe 54 is raised and lowered are themselves firm and rigid.

It is contemplated, in the invention, that other types of grooves could be formed by the rotation-constrained reflex percussion mode of cutting. An example is shown in FIG. 7. Here, the surface 58 on which the groove is to be formed is vertical, such as the wall of a building. The groove 60 is not of the skewed V-shape, but is an ordinary straight-sided channel.

For cutting such a groove, the percussion bars 61 are arranged to span right across the bit 63. The bars are arranged in sequence to extend progressively further into the depth of the groove, i.e. to cut more deeply, as the machine traverses along the groove. Again, if (contrary to the present invention) the bit were allowed to rotate during cutting, the progressive deepening of the groove by the bars acting in sequence could not be achieved, and also the quality of the edges of the groove would be poor.

As shown in FIG. 7, the groove 60 is not skewed, and the axis of the reciprocating assembly lies perpendicularly relative to the concrete surface.

It is recognised, in the invention, that by constraining the bit against rotation, the reflex percussion apparatus can be designed to concentrate the cutting action at the critical points. The bit itself is freed from the requirement to be multi-orientable, and consequently the percussion bars similarly can be concentrated into the critical areas of cutting.

Figure 8:
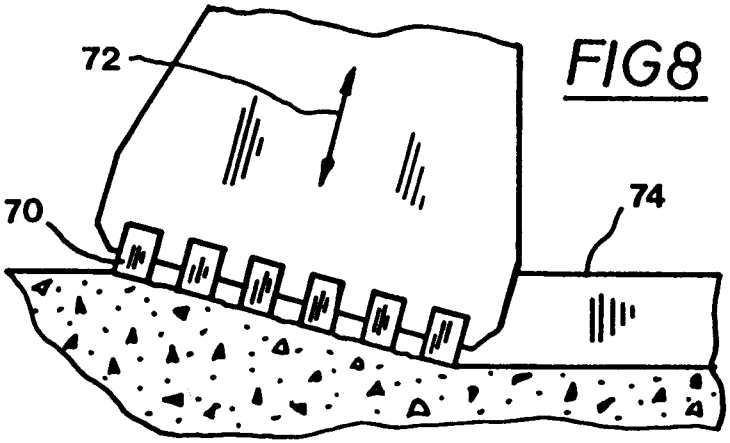

In the embodiments described above, the progressive deepening of the percussion bars into the groove has been achieved by setting each bar to protrude a little further from the face of the bit than the preceding bar. In FIG. 8, it is shown that the progressive deepening can be provided instead by setting the bars 70 all at the same level, and by setting the axis 72 of reciprocation at an angle.

The axis of reciprocation, in the embodiment of FIG. 8, is therefore inclined at an angle to the vertical both when viewed in the front elevation of the apparatus (i.e. along the line of the groove) and when viewed in the side elevation (i.e. perpendicularly to the line of the groove).

Figure 9:
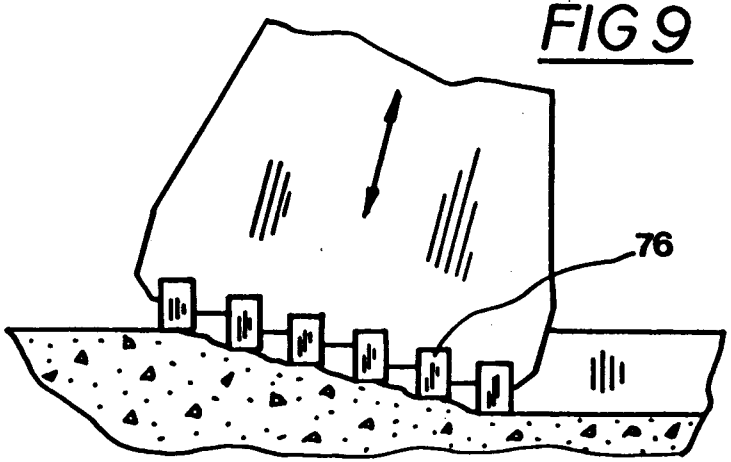

In FIG. 8, the percussion bars 70 strike "flat on" to the surface 74 being cut, rather than with a cutting edge 69 as in FIG. 7. This manner of presenting the bar to the surface is quite acceptable in reflex percussion, since reflex percussion is not a chiselling type of operation, in contrast to the operation of the conventional pneumatic drill. However, it sometimes happens, when the bar is presented "flat on", that the edge of the groove is not quite so sharp, and free from spalling etc. FIG. 9 shows that when the bit is set at an angle relative to the vertical, the percussion bars 76 may then be set at an angle relative to the bit, the result being that the bars 76 are presented edge on to the surface, as in the previous embodiments.

The bit of FIG. 9 is not reversible, however, whereas the bit of FIG. 8 is.

There is a limit to how large an area of the bar can be allowed to strike the surface: if the area were too large, the impact would simply be dissipated, and no cutting would take place. That is why several smaller percussion bars are provided, rather than just a single large percussion bar. If the groove to be cut is a narrow one, however, the rectangular percussion bar 78 as shown in the other figures might be arranged to lie, not across the line of the groove, but along the line of the groove, as shown in FIG. 10.

In the embodiment shown in FIG. 11, again the groove 80 is to be cut to the skewed V-shape. Here, the percussion bars 81 are set in slots 85 which lie not quite at 90 degrees to the line of the groove, but are raked back at a slight angle, as shown. This has the effect of keeping the groove 80 a little clearer than when the bar is at a right angle, because the front face 83 of the bar 81 tends to deflect bouncing debris off to the side, although, as mentioned previously, the grooves usually tend not to become clogged with debris in reflex percussion. One problem with debris is that if it is not positively flicked aside, the debris can lie in the path of the wheels 3 on which the frame 2 of the apparatus 1 is moved over the surface 4: if the heaps of debris are substantial, they can raise the wheel enough to affect the depth to which the groove is cut.

Figure 12:
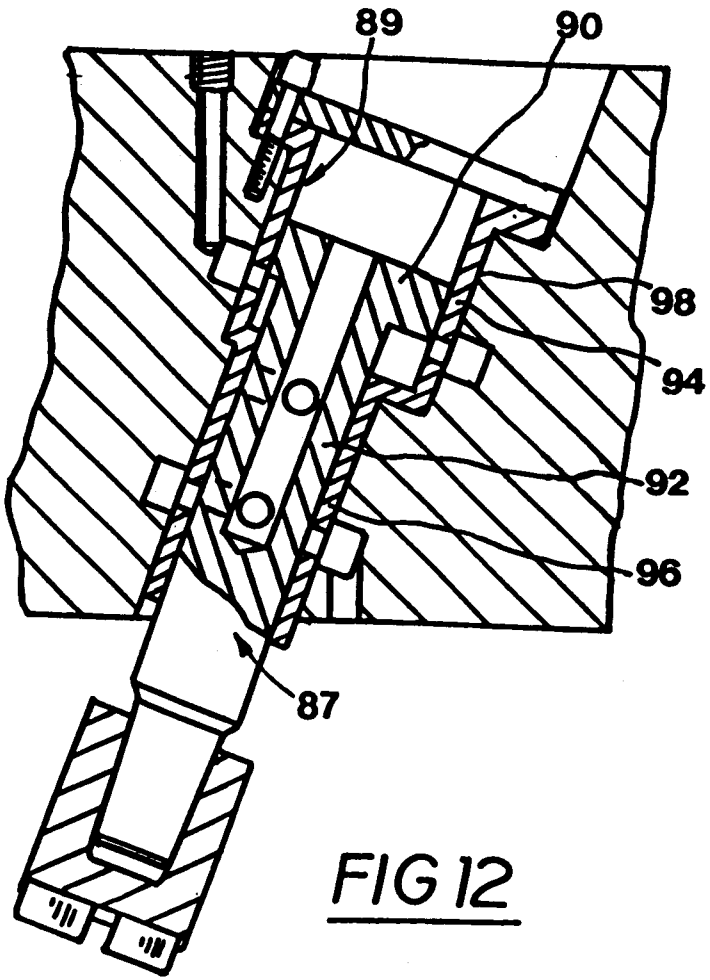
FIG. 12 is a cross-section, corresponding to FIG. 2 of a modified reciprocating assembly.

In an alternative embodiment shown in FIG. 12, the anti-rotation means comprises an operative engagement between an eccentricity of the piston 87, and a complementary eccentricity of the cylinder 89. The eccentricity of the piston 87 may be provided by making the head 90 of the piston eccentric with respect to the main portion 92 of the piston, and the complementary eccentricity of the cylinder 89 may be provided by making the upper portion 94 of the cylinder eccentric with respect to the lower portion 96 of the cylinder. The bore 98 in the cylinder block would also be made eccentric, to suit.

It is preferred for the anti-rotation means to comprise the said eccentricities in some cases, because the anti-rotation means then is enclosed and protected within the pneumatic cylinder. The peg and slot anti-rotation means described earlier, though less troublesome to manufacture, would be more liable to become clogged with dust and debris from the cutting operation.

I claim:

1. Apparatus for cutting a groove in the surface of a hard material by reflex percussion, characterised in that the apparatus includes:

a pneumatically operated piston;

a cutting bar, which is arranged for direct cutting contact with the surface to be cut;

a frame, which includes a cylinder in which the piston is mounted for reciprocating movement along an axis of reciprocation;

a means for fixing the cutting bar to the piston to form a hammer assembly, the said means being such that the piston and cutting bar are, at all times during operation, constrained against all movements relative to each other in the direction of reciprocation;

a double acting pneumatic circuit, which is effective to force the hammer assembly under pressure hard onto the surface to be cut, and is effective then to drive the assembly, under pressure, away from the surface, before the hammer assembly naturally bounces clear of the surface;

a drive means for moving the cutting bar over the surface, and along the line of the groove to be cut;

and an anti-rotation means, which is effective to constrain the cutting bar against rotation relative to the frame, about the axis of reciprocation.

2. Apparatus of claim 1, wherein the piston and cutting bar are fixed together in such a manner that the hammer assembly is a rigid unitary assembly.

3. Apparatus of claim 1, wherein the hammer assembly includes two or more of the said cutting bars, which are arranged in a line along the line of the groove to be cut.

4. Apparatus of claim 3, wherein the cutting bars are arranged, in the hammer assembly, in progressive descending order along the line of the groove to be cut, whereby each successive bar cuts slightly deeper into the surface than the bar that precedes it along the line.

5. Apparatus of claim 4, wherein the axis of reciprocation, when viewed in the direction that lies parallel to the surface and perpendicular to the line of the groove, lies perpendicular to the surface.

6. Apparatus of claim 5, wherein the axis of reciprocation, when viewed in the direction that lies parallel to the surface and in line with the line of the groove, lies at an angle with respect to the surface.

7. Apparatus of claim 1, wherein:

the piston runs in a cylinder formed in the frame of the apparatus;

the anti-rotation means comprises a peg, in operative engagement with a slot;

the peg is mounted in, and extends radially inwards from, the cylinder wall;

and the slot is formed in the piston, and lies parallel to the axis of reciprocation of the piston.

8. Apparatus of claim 1, wherein:

the apparatus includes many of the said hammer assemblies, each running in a respective cylinder;

the said cylinders are mounted in a cylinder block;

the cylinder block is a component of the frame;

and the cylinder block is relatively massive.

9. Apparatus of claim 8, wherein the many cylinders are disposed side by side across the width of the frame, and are so arranged that, during operation of the apparatus, the hammer assemblies cut respective parallel grooves.

10. Apparatus of claim 9, wherein the apparatus includes a means for raising and lowering the said cylinder block with respect to the frame.

11. Apparatus of claim 1, wherein:

the piston runs in a cylinder formed in the frame of the apparatus;

and the anti-rotation means comprises an eccentricity of the piston, which is in operative engagement with a complementary eccentricity of the cylinder.

* * * * *